US010901358B2

(12) United States Patent
Watanabe et al.

(10) Patent No.: US 10,901,358 B2
(45) Date of Patent: Jan. 26, 2021

(54) IMAGE FORMING APPARATUS CAPABLE OF EXECUTING A RUNNING-IN OPERATION FOR A DEVELOPING SECTION

(71) Applicant: KYOCERA Document Solutions Inc., Osaka (JP)

(72) Inventors: Masaru Watanabe, Osaka (JP); Akira Matayoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/809,369

(22) Filed: Mar. 4, 2020

(65) Prior Publication Data

US 2020/0285186 A1 Sep. 10, 2020

(30) Foreign Application Priority Data

Mar. 8, 2019 (JP) ..... 2019-042895

(51) Int. Cl.

| | |
|---|---|
| ***G03G 15/08*** | (2006.01) |
| ***G03G 15/00*** | (2006.01) |
| ***G03G 15/01*** | (2006.01) |
| ***G03G 15/16*** | (2006.01) |

(52) U.S. Cl.

CPC ..... *G03G 15/556* (2013.01); *G03G 15/0189* (2013.01); *G03G 15/1635* (2013.01); *G03G 15/5037* (2013.01)

(58) Field of Classification Search

CPC ..... G03G 15/0849; G03G 15/556
USPC ..... 399/27
See application file for complete search history.

(56) References Cited

U.S. PATENT DOCUMENTS 9,921,523 B1 * 3/2018 Terada ..... G03G 15/556
10,394,176 B2 * 8/2019 Matsumoto ..... G03G 15/0849

FOREIGN PATENT DOCUMENTS

JP 2006243114 A 9/2006

* cited by examiner

*Primary Examiner* — William J Royer
(74) *Attorney, Agent, or Firm* — Studebaker & Brackett PC

(57) ABSTRACT

An image forming apparatus includes a developing section, storage, a first calculation section, a comparing section, and an executing section. The developing section develops an electrostatic latent image with toner. The storage stores coverage rates. The first calculation section calculates a first coverage rate and a second coverage rate. The comparing section compares the first coverage rate with the second coverage rate. The first coverage rate includes one or more coverage rates stored earlier in the storage than the second coverage rate. The second coverage rate includes coverage rates of a specified number of latest images individually formed on a specified number of sheets. A running-in operation is driving the developing section. The executing section executes the running-in operation.

8 Claims, 7 Drawing Sheets

IMAGE FORMING APPARATUS CAPABLE OF EXECUTING A RUNNING-IN OPERATION FOR A DEVELOPING SECTION

INCORPORATION BY REFERENCE

The present application claims priority under 35 U.S.C. § 119 to Japanese Patent Application No. 2019-42895, filed on Mar. 8, 2019. The contents of this application are incorporated herein by reference in their entirety.

BACKGROUND

The present disclosure relates to an image forming apparatus.

An image forming apparatus includes a bearing member, a developing device, a toner replenishing device, and a charge amount detecting means. The developing device develops an electrostatic latent image on the bearing member to form a toner image. The toner replenishing device has a forcibly expelling means for forcibly expelling toner from the developing device. Toner in an amount as much as forcibly expelled by the toner expelling means is replenished by the toner replenishing device. The charge amount detecting means detects a charge amount of toner. The forcibly expelling means forcibly expels toner from the developing device based on a result of detection by the charge amount detecting means.

The image forming apparatus can adjust the charge amount of toner by forcibly expelling toner from the developing device, thereby adjusting image density. Appropriate adjustment of image density can achieve high-quality image formation.

SUMMARY

According to an aspect of the present disclosure, an image forming apparatus for forming an image on a sheet includes a developing section, storage, a first calculation section, a comparing section, and an executing section. The developing section contains toner and develops an electrostatic latent image with the toner. The storage stores respective coverage rates of a plurality of images individually formed on a plurality of sheets in past. The first calculation section calculates a first coverage rate and a second coverage rate. The comparing section compares the first coverage rate with the second coverage rate. The executing section executes a running-in operation based on a result of comparison by the comparing section. The first coverage rate includes one or more coverage rates stored earlier in the storage than the second coverage rate among the coverage rates stored in the storage. The second coverage rate includes coverage rates of a specified number of latest images individually formed on the specified number of sheets among the coverage rates stored in the storage. The running-in operation is driving the developing section so that the charge amount of toner in the developing section comes to be equal to the charge amount of toner for image formation at the first coverage rate on a sheet. When the result of comparison indicates that the second coverage rate is lower than the first coverage rate, the executing section executes the running-in operation.

DETAILED DESCRIPTION

Figure 1:
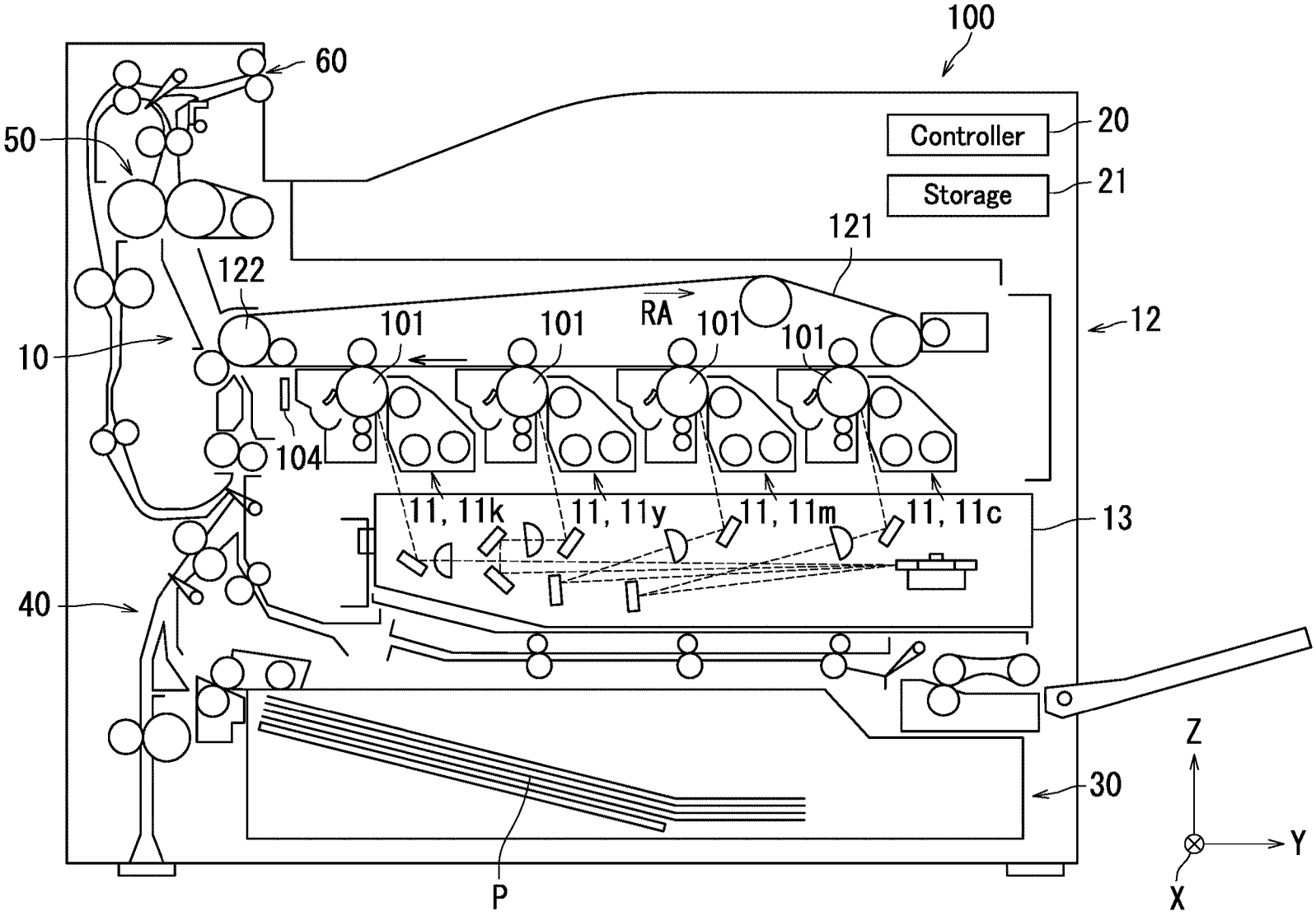
FIG. 1 is a diagram illustrating a configuration of an image forming apparatus according to an embodiment of the present disclosure.

The following describes an embodiment of the present disclosure with reference to drawings. Note that elements that are the same or equivalent are indicated by the same reference signs in the drawings and description thereof is not repeated. In the embodiments, X and Y axes are parallel to a horizontal plane, and a Z axis is parallel to a vertical direction. The X, Y, and Z axes are orthogonal to each other.

First, a configuration of an image forming apparatus 100 according to the present embodiment will be described with reference to FIG. 1. FIG. 1 is a diagram illustrating the configuration of the image forming apparatus 100. The image forming apparatus 100 is for example a color multi-function peripheral.

As illustrated in FIG. 1, the image forming apparatus 100 includes an image forming unit 10, a feeding section 30, a conveyance section 40, a fixing section 50, an ejection section 60, a controller 20, and storage 21.

The feeding section 30 feeds a sheet P to the conveyance section 40. The conveyance section 40 conveys the sheet P to the ejection section 60 via the image forming unit 10 and the fixing section 50. The image forming unit 10 forms an image on the sheet P. The fixing section 50 applies heat and pressure to the sheet P to fix the image formed on the sheet P, thus fixing the image formed on the sheet P to the sheet P. The ejection section 60 ejects the sheet P out of the image forming apparatus 100.

Next, a configuration of the image forming unit 10 will be described. The image forming unit 10 includes a plurality of image forming sections 11, an exposure section 13, and a transfer section 12.

Toners of mutually different colors are supplied to the respective image forming sections 11. The toners each include a large number of toner particles. The image forming sections 11 each include a photosensitive drum 101.

A toner image is formed on the photosensitive drum 101.

The exposure section 13 exposes a surface of each photosensitive drum 101. Specifically, the exposure section 13 exposes the respective photosensitive drums 101 with light based on image data. As a result, an electrostatic latent image is formed on each of the photosensitive drums 101. The exposure section 13 includes a light source, a polygon mirror, a reflecting mirror, and a deflecting mirror, for example.

The image forming sections 11 then develop the respective electrostatic latent images formed on the photosensitive drums 101 to form toner images on the photosensitive drums 101. As a result, toner images of mutually different colors are formed on the respective photosensitive drums 101.

The transfer section 12 transfers the toner images to the sheet P. As a result, an image is formed on the sheet P.

The controller 20 controls elements of the image forming apparatus 100, such as the image forming unit 10, the feeding section 30, the conveyance section 40, the fixing section 50, and the ejection section 60. The controller 20 includes storage and a processor such as a central processing unit (CPU) or an application specific integrated circuit (ASIC).

The storage 21 includes a storage device and stores data and computer programs therein. Specifically, the storage 21 includes a main storage device such as semiconductor memory and an auxiliary storage device such as semiconductor memory and a hard disk drive. The storage 21 may include a removable medium. The data includes coverage rates of a plurality of images individually formed on each of a plurality of sheets P in past. The coverage rates each are a rate of an integrated area of an image formed on a sheet P to the area of the sheet P.

Figure 2:
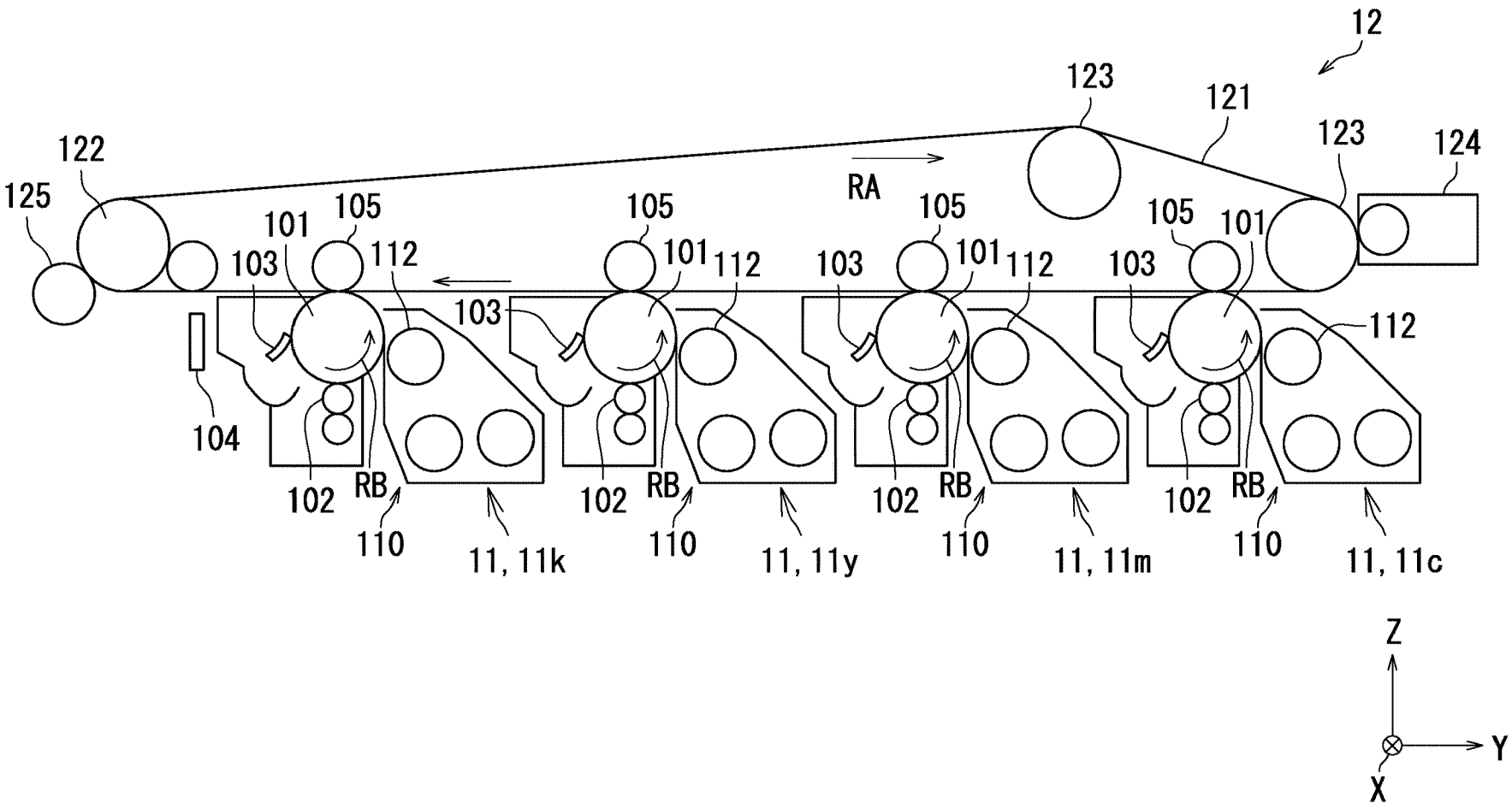
FIG. 2 is a cross-sectional view of an example of a configuration of image forming sections and a transfer section according to the embodiment.

Next, a configuration of each image forming section 11 and the transfer section 12 in the present embodiment will be described with reference to FIGS. 1 and 2. FIG. 2 is a cross-sectional view of an example of the configuration of the image forming section 11 and the transfer section 12.

The transfer section 12 includes an intermediate transfer belt 121, a drive roller 122, a driven roller 123, a belt cleaning section 124, and a secondary transfer roller 125.

Toner images are transferred from the photosensitive drums 101 to the intermediate transfer belt 121. Specifically, the toner images are transferred from the photosensitive drums 101 to a specified area of the intermediate transfer belt 121. The intermediate transfer belt 121 is an endless belt.

The intermediate transfer belt 121 is stretched around the drive roller 122 and the driven roller 123. The drive roller 122 rotates the intermediate transfer belt 121. The driven roller 123 rotates with the rotation of the intermediate transfer belt 121. The belt cleaning section 124 removes toner remaining on a surface of the intermediate transfer belt 121.

The secondary transfer roller 125 transfers the toner images formed on the intermediate transfer belt 121 to the sheet P. The secondary transfer roller 125 is pressed by the drive roller 122, thereby forming a nip part between the secondary transfer roller 125 and the drive roller 122. When the sheet P passes through the nip part, the secondary transfer roller 125 transfers the toner images formed to the specified area of the intermediate transfer belt 121 onto the sheet P. As a result, an image is formed on the sheet P.

The image forming sections 11 will be further described in detail with reference to FIGS. 1 and 2.

The image forming sections 11 include an image forming section 11*c* to which a cyan toner is supplied, an image forming section 11*m* to which a magenta toner is supplied, an image forming section fly to which a yellow toner is supplied, and an image forming section 11*k* to which a black toner is supplied.

The image forming sections 11*c*, 11*m*, 11*y*, and 11*k* have substantially identical configurations. Here, the image forming section 11*c* will be described as an example.

The image forming sections 11 each further include a cleaner 103, a developing section 110, a charger 102, a primary transfer roller 105, and a density detector 104 in addition to the photosensitive drum 101.

The photosensitive drum 101 has a substantially columnar or cylindrical shape. The photosensitive drum 101 rotates in a rotational direction RB about a rotational axis of the photosensitive drum 101. The rotational direction RB is a direction opposite to a rotational direction RA. The rotational direction RA is for example a clockwise direction. Examples of the photosensitive drum 101 include an amorphous silicon (α-Si) photosensitive drum and an organic photoconductor (OPC) drum.

The cleaner 103 removes toner adhering to the surface of the photosensitive drum 101. The cleaner 103 includes a cleaning blade 103*a*.

The cleaning blade 103*a* wipes the surface of the photosensitive drum 101. By wiping the surface of the photosensitive drum 101 with an edge of the cleaning blade 103*a*, remaining toner is removed from the surface of the photosensitive drum 101.

The developing section 110 contains toner and develops an electrostatic latent image with the toner. Specifically, the developing section 110 forms a toner image on the photosensitive drum 101 by developing an electrostatic latent image formed on the rotating photosensitive drum 101 with the toner. That is, the developing section 110 forms a toner image on the photosensitive drum 101 with the toner.

The developing section 110 includes a development roller 112. The development roller 112 carries toner.

The charger 102 charges the surface of the photosensitive drum 101 to a specified potential. The charger 102 includes for example a charging roller. After the charger 102 charges the surface of the photosensitive drum 101 to a specified potential, the exposure section 13 exposes a specified area of the photosensitive drum 101 to form an electrostatic latent image in the specified area of the photosensitive drum 101.

The primary transfer roller 105 transfers the toner images formed on the respective photosensitive drums 101 to the intermediate transfer belt 121. For example, the primary transfer roller 105 sequentially transfers a cyan toner image, a magenta toner image, a yellow, toner image, and a black toner image from the corresponding photosensitive drums 101 to the specified area of the intermediate transfer belt 121. As a result, the cyan toner image, the magenta toner image, the yellow toner image, and the black toner image can be superimposed in the specified area of the intermediate transfer belt 121.

The density detector 104 detects each density of the toner images transferred on the intermediate transfer belt 121. For example, the density detector 104 detects the density of the toner image transferred to the specified area of the intermediate transfer belt 121.

In the present embodiment, the density of a toner image indicates a mass of toner forming the toner image per unit area. The density of the toner image is calculated based on for example a thickness of the toner image. Therefore, the density detector 104 detects a toner image thickness HT in a specified area. In detail, the density detector 104 measures a distance LT between the density detector 104 and the toner image to detect the toner image thickness HT. In further detail, the density detector 104 detects the toner image thickness HT using the following equation (1).

$$(\text{Thickness } HT) = (\text{Reference distance } LTA) - (\text{Distance } LT) \quad (1)$$

It should be noted that the reference distance LTA is the distance between the density detector 104 and the outer surface of the intermediate transfer belt 121.

The density detector 104 is for example a laser displacement sensor. The laser displacement sensor includes a semiconductor laser and a linear image sensor, and measures the distance LT using triangulation. The density detector 104 outputs a detection signal indicating the density of the toner image to the controller 20.

Figure 3:
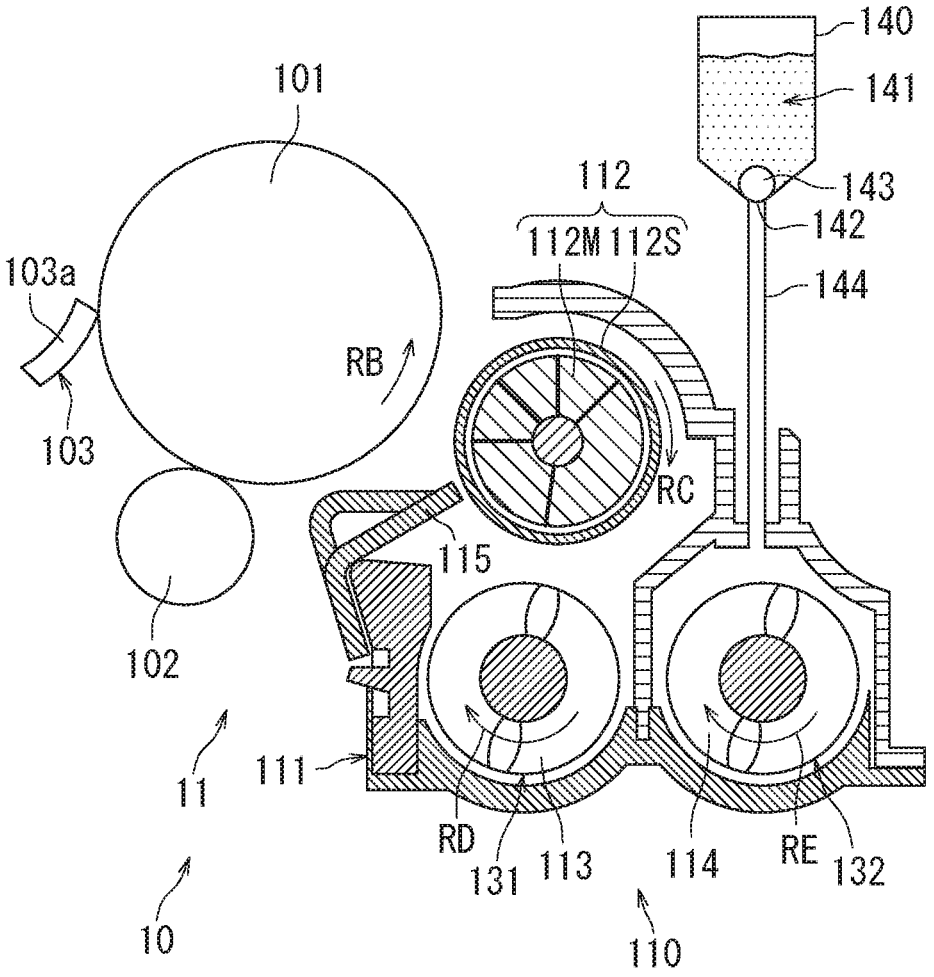
FIG. 3 is a diagram illustrating a developing section and a replenishing section according to the embodiment.

Next, an image forming apparatus 100 will be described in detail with reference to FIG. 3. FIG. 3 is a diagram illustrating a developing section 110 and a replenishing section 140. The image forming apparatus 100 further includes replenishing sections 140.

Each of the replenishing sections 140 replenishes a corresponding one of the developing sections 110 with toner. The replenishing section 140 is connected to the developing section 110. The replenishing section 140 includes a toner container 141, a replenishing port 142, an opening and closing member 143, and a replenishing path 144.

The toner container 141 contains toner. The replenishing port 142 is located in the toner container 141. The replenishing path 144 guides the toner to the developing section 110.

The opening and closing member 143 opens or closes the replenishing port 142 according to an instruction from the controller 20. When the replenishing port 142 is opened by the opening and closing member 143, the developing section 110 is replenished with toner. When the replenishing port 142 is closed by the opening and closing member 143, the developing section 110 is not replenished with toner. The amount of toner with which the developing section 110 is replenished by the replenishing section 140 corresponds to an amount of toner supplied to the photosensitive drum 101 by the developing section 110.

Each developing section 110 of the image forming apparatus 100 includes a development housing 111, a development roller 112, a first screw feeder 113, a second screw feeder 114, a regulation blade 115, and a suction fan (not illustrated).

The development housing 111 contains a two-component developer. The development housing 111 includes a first conveyance section 131 and a second conveyance section 132. In the first conveyance section 131, the two-component developer is conveyed in a first conveyance direction which is from one end to the other end of the development roller 112 in an axial direction thereof. In the second conveyance section 132, the two-component developer is conveyed in a second conveyance direction which is opposite to the first conveyance direction.

Specifically, the second conveyance section 132 includes the second screw feeder 114. The second screw feeder 114 conveys the two-component developer in the second conveyance direction by rotating in a rotational direction RE. The first conveyance section 131 includes the first screw feeder 113. The first screw feeder 113 conveys the two-component developer in the first conveyance direction by rotating in a rotational direction RD. The first screw feeder 113 supplies the two-component developer to the development roller 112 by conveying the two-component developer in the first conveyance direction.

The two-component developer includes a toner and a carrier. Specifically, the two-component developer includes a toner including a large number of toner particles and a carrier including a large number of carrier particles. The toner particles are a powder and the carrier particle is a powder. The toner is for example a positively chargeable toner. The positively chargeable toner is positively charged by friction with the carrier. The carrier is magnetic. The carrier is for example a resin-coated carrier. The resin-coated carrier has a core made from for example ferrite or magnetite.

The development roller 112 carries the toner. The development roller 112 is located opposite to the photosensitive drum 101. The development roller 112 includes a sleeve 112S and a magnet 112M.

The sleeve 112S is a non-magnetic cylinder (an aluminum pipe, for example). The sleeve 112S is driven for example by a motor, and rotates in a rotational direction RC about the magnet 112M.

The magnet 112M is located inside the sleeve 112S. The magnet 112M attracts the carrier through the magnetic force of the magnet 112M. As a result, magnetic brushes are formed on the surface of the sleeve 112S. The toner is carried on the surface of the carrier. That is, the toner is carried on the surface of the development roller 112 through being carried by the magnetic brushes.

The regulation blade 115 is located opposite to the development roller 112 with a specified space therebetween. The regulation blade 115 regulates each length of bristles of the magnetic brush formed on the surface of the development roller 112.

The suction fan sucks toner floating between the photosensitive drum 101 and the development roller 112.

Figure 4:
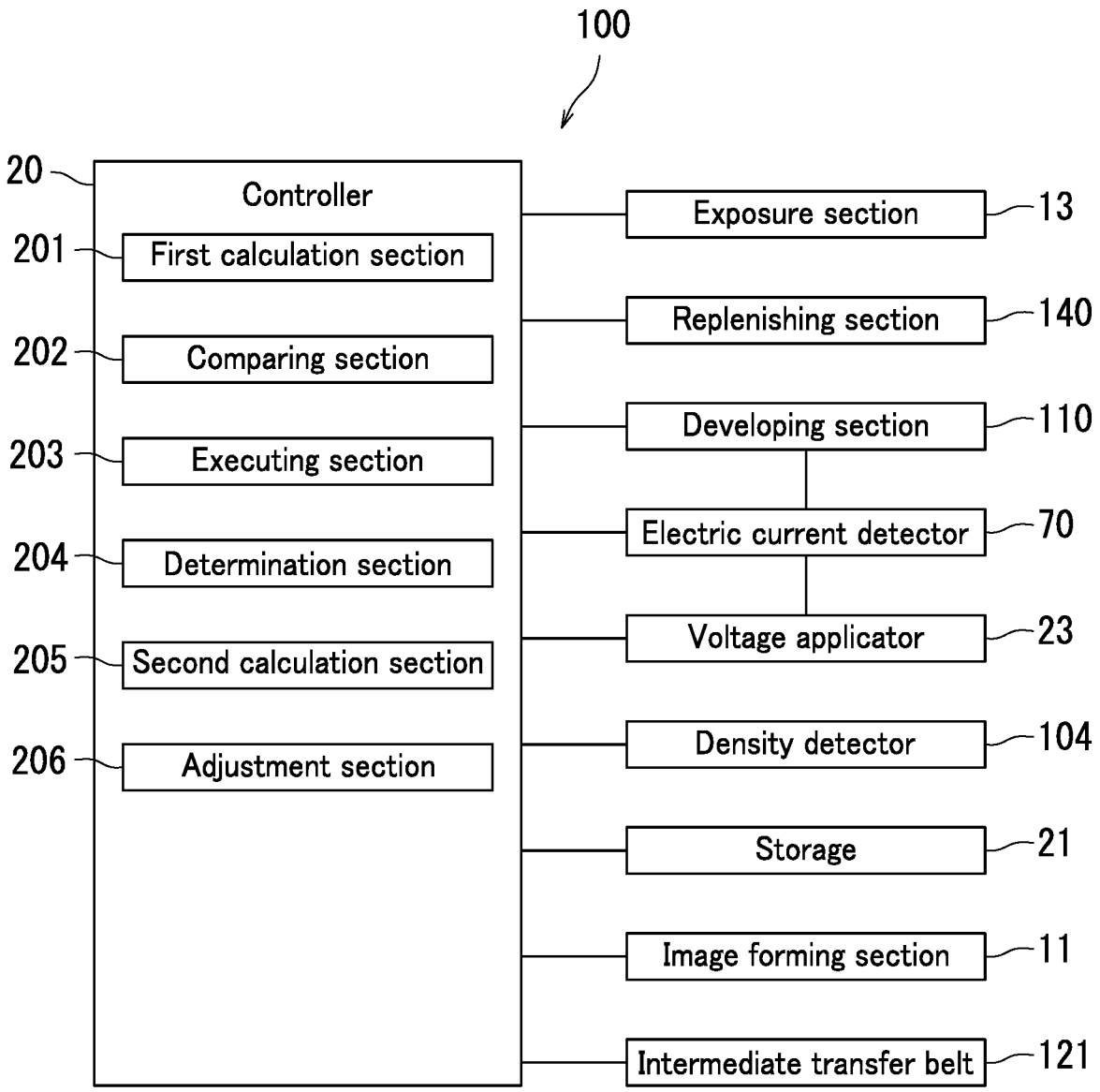
FIG. 4 is a diagram illustrating a controller of the image forming apparatus according to the embodiment.

Next, the image forming apparatus 100 will be described in further detail with reference to FIGS. 3 and 4. FIG. 4 is a diagram illustrating the controller 20 of the image forming apparatus 100. The image forming apparatus 100 further includes a voltage applicator 23 and an electric current detector 70 as illustrated in FIG. 4.

The voltage applicator 23 applies a development bias (specified voltage) to the development roller 112. By applying the development bias to the development roller 112, the voltage applicator 23 provides a potential difference between the photosensitive drum 101 and the development roller 112.

As a result of the specified potential difference between the photosensitive drum 101 and the development roller 112 attained through application of the development bias to the development roller 112, the toner carried on the development roller 112 is electrically attracted. Thus, the toner flies from the development roller 112 toward the electrostatic latent image on the photosensitive drum 101. The flying toner moves from the development roller 112 toward the photosensitive drum 101. As a result, a toner image is formed on the surface of the photosensitive drum 101.

The electric current detector 70 detects an electric current flowing between the photosensitive drum 101 and the developing section 110. Specifically, the electric current detector 70 detects an electric current flowing between the photosensitive drum 101 and the developing section 110 when the toner moves from the development roller 112 toward the photosensitive drum 101.

The configuration of the controller 20 will be further described in detail with reference to FIG. 4. The controller 20 further includes a first calculation section 201, a comparing section 202, an executing section 203, and a determination section 204. The controller 20 executes a computer program stored in the storage device of the storage 21, thereby functioning as the first calculation section 201, the comparing section 202, the executing section 203, and the determination section 204.

The first calculation section 201 calculates a first coverage rate and a second coverage rate. The first coverage rate includes one or more coverage rates stored earlier in the storage 21 than the second coverage rate among the coverage rates stored in the storage 21. The first coverage rate is for example a coverage rate of an image frequently formed on sheets P among the coverage rates stored in the storage 21. Furthermore, the first coverage rate may be for example an average value of coverage rates stored earlier in the storage 21 than the second coverage rate among the coverage rates stored in the storage 21.

The second coverage rate includes coverage rates of a specified number of latest images individually formed on the specified number of sheets among the coverage rates stored in the storage 21. The second coverage rate may be for example a coverage rate of the latest image formed on a sheet P among coverage rates of images formed on sheets P by the image forming apparatus 100. Alternatively, the second coverage rate may be for example an average value of coverage rates of 30 latest images formed on 30 sheets P among coverage rates stored in the storage 21. The latest coverage rate includes coverage rates of images formed on sheets P before the current time. For example, the latest coverage rate includes the print rate of an image formed on a sheet P in a job executed the latest. Alternatively, the second coverage rate may be for example an average value of coverage rates of a specified number of latest images formed on the specified number of sheets among coverage rates stored in the storage 21.

The comparing section 202 compares the first coverage rate with the second coverage rate. The comparing section 202 sends a signal indicating a result of comparison to the controller 20.

For example, when the comparing section 202 determines according to a result of comparison between the first coverage rate and the second coverage rate that the second coverage rate is higher than the first coverage rate, the comparing section 202 sends to the controller 20 a signal indicating that the second coverage rate is higher than the first coverage rate. For example, when the comparing section 202 determines according to a result of comparison between the first coverage rate and the second coverage rate that the second coverage rate is not higher than the first coverage rate, the comparing section 202 sends to the controller 20 a signal indicating that the second coverage rate is not higher than the first coverage rate.

Furthermore, for example, when the comparing section 202 determines according to a result of comparison between the first coverage rate and the second coverage rate that the second coverage rate is lower than the first coverage rate, the comparing section 202 sends to the controller 20 a signal indicating that the second coverage rate is lower than the first coverage rate. For example, when the comparing section 202 determines according to a result of comparison between the first coverage rate and the second coverage rate that the second coverage rate is not lower than the first coverage rate, the comparing section 202 sends to the controller 20 a signal indicating that the second coverage rate is not lower than the first coverage rate.

Furthermore, for example, when the comparing section 202 determines according to a result of comparison between the first coverage rate and the second coverage rate that the second coverage rate is not higher than the first coverage rate and not lower than the first coverage rate, the comparing section 202 sends to the controller 20 a signal indicating that the second coverage rate is equal to the first coverage rate.

The executing section 203 executes a running-in operation based on a result of comparison by the comparing section 202. The running-in operation means driving the developing section 110 so that the charge amount of toner in the developing section 110 is equal to the charge amount of toner for image formation at the first coverage rate on a sheet P. The executing section 203 executes a running-in operation so that the charge amount of toner in the developing section 110 comes to be equal to the charge amount of toner for formation of a frequently formed image having the first coverage rate. That is, the charge amount of toner in the developing section 110 can be stabilized at the charge amount of toner for image formation at the first coverage rate. Therefore, density variation among images formed at the first coverage rate on sheets P can be inhibited. As a result of executing the running-in operation, images having an equal density can be formed on sheets P.

Further, the charge amount of toner for image formation at the first coverage rate on the sheet P is selected from a correspondence table pre-stored in the storage 21. The correspondence table includes a plurality of values. The charge amount may indicate one of the values included in the correspondence table. Also, the charge amount may indicate from a specified value to another specified value among the values included in the correspondence table.

When the result of comparison by the comparing section 202 indicates that the second coverage rate is lower than the first coverage rate, the executing section 203 executes the running-in operation. Accordingly, even in a situation in which the charge amount of toner in the developing section 110 has come to the charge amount of toner for image formation at the second coverage rate, the charge amount of toner in the developing section 110 can be changed to the charge amount of toner for image formation at the first coverage rate in advance. As a result, in image formation at the first coverage rate on sheets P after execution of the running-in operation, density variation among the images formed at the first coverage rate on sheets P can be inhibited, thereby achieving formation of the images having an equal density on the sheets P.

For example, in situation in which the charge amount of toner in the developing section 110 is the charge amount of toner for image formation at the second coverage rate on a sheet P, image formation at the first coverage rate on a plurality of sheets P results in images having different densities on the sheets P. Specifically, the density varies in image formation on sheets P until the charge amount of toner in the developing section 110 is stabilized at the charge amount of toner for image formation at the first coverage rate on a sheet P. Thus, formation of images having an equal density on sheets P cannot be achieved.

By contrast, as a result of executing the running-in operation, the charge amount of toner in the developing section 110 comes to the charge amount of toner for image formation at the first coverage rate on a sheet P. In a case where an image having the first coverage rate is formed on each of a plurality of sheets P after the running-in operation, density variation among the formed images on the sheets P can be inhibited, and images having an equal density can be formed on the sheets P.

In order to execute the running-in operation, the executing section 203 drives the first screw feeder 113 and the second screw feeder 114 so that the charge amount of toner in the developing section 110 comes to be equal to the charge amount of toner for image formation at the first coverage rate on a sheet P. The rotation of the first screw feeder 113 and the second screw feeder 114 causes friction between the toner and the carrier. As a result, the charge amount of toner in the developing section 110 comes to be equal to the charge amount of toner for image formation at the first coverage rate on a sheet P.

When the second coverage rate is lower than the first coverage rate, the executing section 203 controls the replenishing section 140 so that the replenishing section 140 replenishes the developing section 110 with toner. Furthermore, the executing section 203 controls the developing section 110 so that the developing section 110 expels toner, and controls the executing section 203 so that the executing section 203 executes the running-in operation. As a result of expelling by the developing section 110, charged toner is expelled from the developing section 110. As a result of replenishment by the replenishing section 140, the developing section 110 is replenished with toner that is not charged. Therefore, the toner in the developing section 110 is replaced, and consequently the charge amount of toner in the developing section 110 decreases. Thus, the charge amount of toner in the developing section 110 can be readily changed to the charge amount of toner for image formation at the first coverage rate.

Generally, the lower the coverage rate of an image formed on the sheet P is, the less toner is supplied from the developing section 110 to the photosensitive drum 101. Toner replacement in the developing section 110 decreases accordingly. Therefore, toner stays longer in the developing section 110. As a result, the toner and the carrier are excessively rubbed against each other, causing increase in the charge amount of toner, and thus the charge amount of the toner in the developing section 110 increases.

However, by replacing the toner in the developing section 110, the charge amount of toner in the developing section 110 can be readily changed. Thus, the charge amount of toner in the developing section 110 can be readily changed to the charge amount of toner for image formation at the first coverage rate.

After the developing section 110 forms an image on a sheet P, the executing section 203 in the present embodiment executes a running-in operation based on a result of comparison by the comparing section 202. Therefore, after the image forming section 11 forms an image on a sheet P, the running-in operation can be executed. That is, even in a situation in which an image having a coverage rate different from the first coverage rate has been formed on a sheet P, the charge amount of toner in the developing section 110 can be changed to the charge amount of toner for formation of a frequently formed image at the first coverage rate. As a result, in formation of an image at the first coverage rate on sheets P after execution of the running-in operation, density variation among the formed images on the sheets P can be inhibited, thereby achieving formation of images having an equal density on sheets P.

The executing section 203 in the present embodiment executes the running-in operation at a specified time. As time elapses, toner discharges. That is, the charge amount of toner decreases with time. In view of the foregoing, the executing section 203 in the present embodiment executes the running-in operation at a specified time. That is, even if the charge amount of toner decreases with time, the charge amount of toner in the developing section 110 can be changed to the charge amount of toner for formation of a frequently formed image having the first coverage rate. As a result, in image formation at the first coverage rate on sheets P after execution of the running-in operation, density variation among the images formed at the first coverage rate formed on the sheets P can be inhibited, thereby achieving formation of images having an equal density on the sheets P.

For example, the executing section 203 executes the running-in operation at 8:30 am. In a case where the image forming apparatus 100 is to be used from 9:00 am, the running-in operation is executed before 9:00 am in order to execute the running-in operation before use of the image forming apparatus 100 by a user. Therefore, image formation on sheets P can be executed with inhibited density variation.

The controller 20 in the present embodiment determines whether or not a specified time period has elapsed since the developing section 110 formed an image on a sheet P. When the specified time period has elapsed, the controller 20 changes the power state of the developing section 110 from a second power state to a first power state. When the specified time period has not elapsed, the controller 20 does not change the power state of the developing section 110 from the second power state to the first power state. The first power state is a state in which power consumption is lower than in the second power state. The first power state is also called a standby state. In the first power state, power is not supplied to the developing section 110. The second power state is a state in which power consumption is higher than in the first power state. The second power state is also called a normal state. Further, when the image forming apparatus 100 in the first power state receives an instruction from a user, the controller 20 controls a power supply (not illustrated) such that the power supply supplies power to the developing section 110. As a result, the developing section 110 returns from the first power state to the second power state.

The executing section 203 in the present embodiment executes the running-in operation when the developing section 110 returns from the first power state to the second power state. The longer the period of the first power state is, the more the toner discharges to have a decreased charge amount. In view of the foregoing, when the image forming apparatus 100 returns from the first power state to the second power state, the running-in operation is executed. That is, even when the charge amount of toner has decreased due to a prolonged period of the first power state, the charge amount of toner in the developing section 110 can be changed to the charge amount of toner for formation of a frequently formed image having the first coverage rate. As a result, in image formation at the first coverage rate on sheets P after execution of the running-in operation, density variation among the images formed at the first coverage rate on sheets P can be inhibited, thereby achieving formation of the images having an equal density on the sheets P.

The determination section 204 determines a time period for executing the running-in operation based on a difference between the first coverage rate and the second coverage rate. The time period for the running-in operation can be determined depending on a difference between the first coverage rate and the second coverage rate. As a result, a time period for attaining the charge amount of toner at the first coverage rate can be secured.

The larger the difference between the first coverage rate and the second coverage rate is, the longer the time period for the running-in operation is. By contrast, the smaller the difference between the first coverage rate and the second coverage rate is, the shorter the time period for the running-in operation is. Therefore, the determination section 204 can determine an appropriate time period for the running-in operation.

The configuration of the controller 20 will be further described in detail with reference to FIG. 4. The controller 20 further includes a second calculation section 205 and an adjustment section 206. The controller 20 executes a computer program stored in the storage device of the storage 21, thereby functioning as the second calculation section 205 and the adjustment section 206.

Further, the second calculation section 205 calculates a charge amount of toner based on an electric current detected by the electric current detector 70 and a density of the toner image transferred to the intermediate transfer belt 121 that is detected by the density detector 104.

For example, when calculating a charge amount, the second calculation section 205 receives from the density detector 104 a detection signal indicating a density of the toner image transferred from the photosensitive drum 101 to the intermediate transfer belt 121. Then, the second calculation section 205 calculates an amount M of toner forming the toner image based on the density of the toner image indicated by the detection signal. The amount M of toner indicates a mass of toner forming the toner image.

Furthermore, the second calculation section 205 receives from the electric current detector 70 a detection signal indicating an electric current value of an electric current flow. Then, the controller 20 calculates a charge amount Q of toner forming a toner image based on the electric current value of the electric current flow indicated by the detection signal.

Furthermore, the second calculation section 205 calculates a charge amount QPM of toner based on the amount M of toner and the total charge amount Q. Specifically, the charge amount QPM of toner is expressed by QPM=Q/M. Accordingly, the charge amount QPM of toner is a charge amount of toner per unit of mass.

The adjustment section 206 adjusts conditions for forming an image on a sheet P based on the charge amount. The charge amount can be calculated from the density of the toner image and the electric current detected by the electric current detector 70. Then, based on the calculated charge amount, the conditions for forming an image on the sheet P can be set. As a result, a high-quality image can be formed on the sheet P.

Furthermore, the adjustment section 206 in the present embodiment adjusts based on the charge amount QPM at least one of an amount of toner supplied from the developing section 110 to the photosensitive drum 101, a rotational speed of the development roller 112, a development bias applied to the development roller 112, a surface potential of the photosensitive drum 101, and an output of the suction fan for sucking toner scattered in the developing section 110.

Accordingly, the conditions for forming an image on the sheet P can be adjusted based on changes in the charge amount QPM of toner. As a result, decrease in image density, occurrence of fogging, and increase in toner scattering can be inhibited, and image formation on sheets P can be performed under appropriate conditions.

For example, the adjustment section 206 adjusts the potential of the surface of the photosensitive drum 101 when the surface is charged to a specified potential by the charger 102 based on the charge amount QPM of toner. As a result, decrease in image density can be inhibited. For example, the adjustment section 206 adjusts the development bias applied to the development roller 112 by the voltage applicator 23 based on the charge amount QPM of toner. As a result, decrease in image density and aggravation of fogging can be inhibited. For example, the adjustment section 206 adjusts the rotational speed of the development roller 112 based on the charge amount QPM of toner. As a result, while decrease in image density is inhibited, aggravation of fogging can be inhibited.

Figure 5:
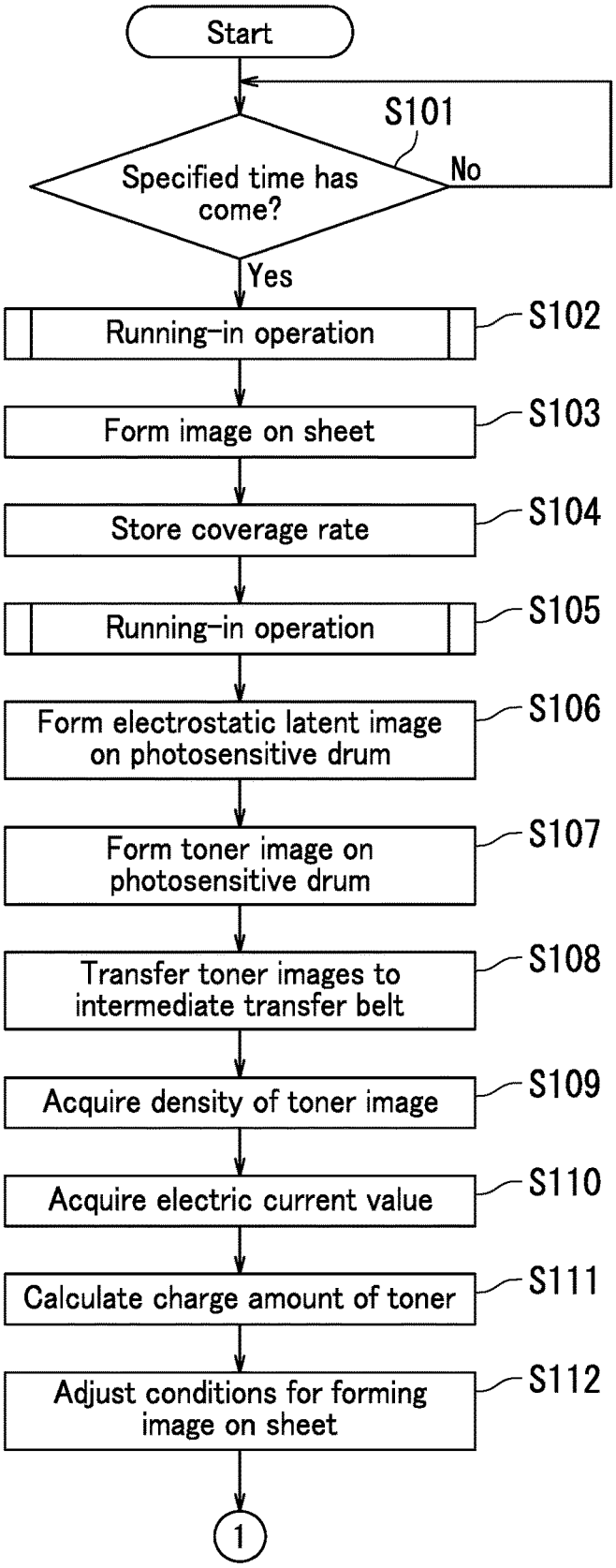
FIG. 5 is a flowchart depicting a process executed by the controller in the embodiment.
Figure 6:
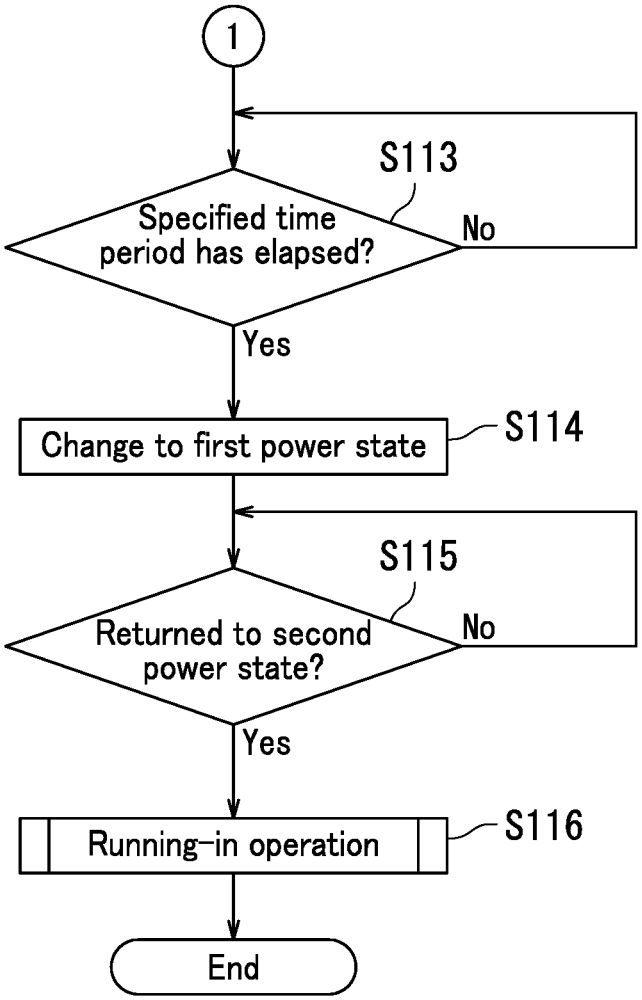
FIG. 6 is a continuation of the flowchart depicting the process executed by the controller in the embodiment.

Next, a process performed by the controller 20 will be described with reference to FIGS. 4 to 6. FIG. 5 is a flowchart depicting a process executed by the controller 20. FIG. 6 is a continuation of the flowchart depicting the process executed by the controller 20 illustrated in FIG. 5. The process executed by the controller 20 illustrated in FIGS. 5 and 6 includes Steps S101 to S116.

In Step S101, the controller 20 determines whether or not a specified time has come. If the specified time has not come (No in Step S101), the process repeats Step S101. If the specified time has come (Yes in Step S101), the process proceeds to Step S102.

If Yes in Step S101, the executing section 203 executes a running-in operation in Step S102. The running-in operation will be described later with reference to FIG. 7. The process proceeds to Step S103.

In Step S103, the controller 20 controls the image forming sections 11 so that the image forming sections 11 form images on sheets P. The process proceeds to Step S104.

In Step S104, the controller 20 controls the storage 21 so that the storage 21 stores respective coverage rates of a plurality of images individually formed on the plurality of sheets P by the image forming section 11. The process proceeds to Step S105.

In Step S105, the executing section 203 executes the running-in operation. The process proceeds to Step S106.

In Step S106, the controller 20 controls the exposure section 13 so that the exposure section 13 forms an electrostatic latent images on the respective photosensitive drums 101. The process proceeds to Step S107.

In Step S107, the controller 20 controls the developing sections 110 so that the developing sections 110 develop the electrostatic latent images on the respective photosensitive drums 101 with toner to form toner images on the photosensitive drums 101. The process proceeds to Step S108.

In Step S108, the controller 20 controls the intermediate transfer belt 121 so that the toner images are transferred to the intermediate transfer belt 121 from the photosensitive drums 101. The process proceeds to Step S109.

In Step S109, the second calculation section 205 acquires from the density detector 104 the density of each toner image transferred to the intermediate transfer belt 121. The process proceeds to Step S110.

In Step S110, the second calculation section 205 acquires from the electric current detector 70 the electric current value of the electric current flowing between each photosensitive drum 101 and a corresponding one of the developing sections 110. The process proceeds to Step S111.

In Step S111, the second calculation section 205 calculates the charge amount of toner based on the electric current value detected by the electric current detector 70 and the density of each toner image transferred to the intermediate transfer belt 121 that is detected by the density detector 104. The process proceeds to Step S112.

In Step S112, the adjustment section 206 adjusts conditions for forming an image on a sheet P based on the charge amount. The process proceeds to Step S113.

In Step S113, the controller 20 determines whether or not a specified time period has elapsed since the developing section 110 formed an image on a sheet P. If the specified time period has not elapsed (No in Step S113), the process repeats Step S113. If the specified time period has elapsed (Yes in Step S113), the process proceeds to Step S114.

If Yes in Step S113, the controller 20 changes the power state of the developing section 110 from the second power state to the first power state in Step S114. The process proceeds to Step S115.

In Step S115, the controller 20 determines whether or not the developing sections 110 have returned from the first power state to the second power state. If the developing sections 110 have not returned from the first power state to the second power state (No in Step S115), the process repeats Step S115. If the developing sections 110 have returned from the first power state to the second power state (Yes in Step S115), the process proceeds to Step S116.

If Yes in Step S115, the executing section 203 executes the running-in operation in Step S116. The process ends.

Figure 7:
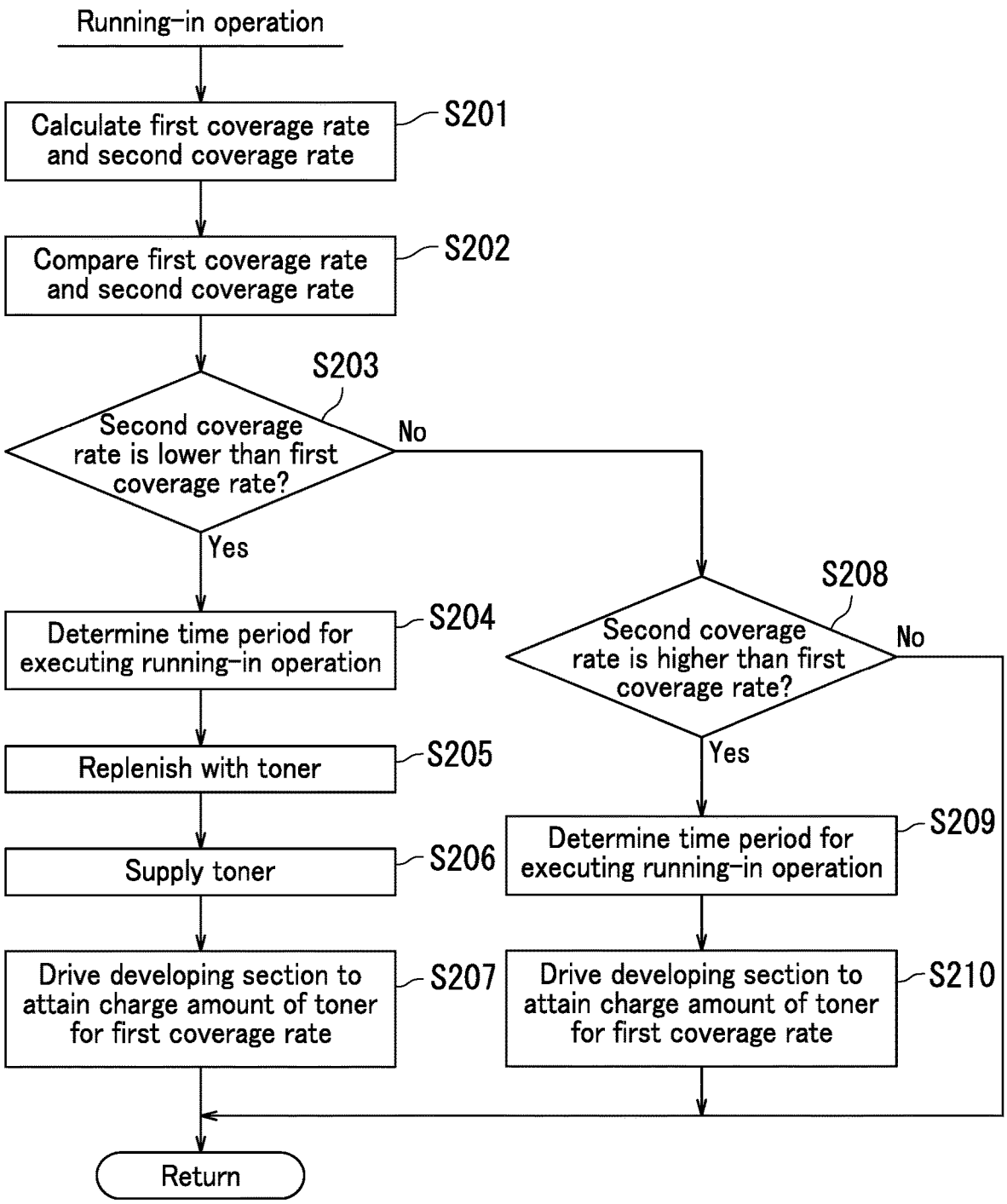
FIG. 7 is a flowchart depicting a process of the running-in operation in the embodiment.

Next, the running-in operation will be described with reference to FIG. 7. FIG. 7 is a diagram illustrating a flowchart of a process of the running-in operation. The controller 20 executes Steps S201 to S210 depicted in FIG. 7 as the running-in operation of Step S102 depicted in FIG. 5. Note that the controller 20 executes Steps S201 to S210 depicted in FIG. 7 in also Step S105 depicted in FIG. 5 and Step S116 depicted in FIG. 6.

In Step S201, the first calculation section 201 calculates a first coverage rate and a second coverage rate. The process proceeds to Step S202.

In Step S202, the comparing section 202 compares the first coverage rate with the second coverage rate. The process proceeds to Step S203.

In Step S203, the comparing section 202 determines whether or not the second coverage rate is lower than the first coverage rate. If the comparing section 202 determines according to a result of comparison between the first coverage rate and the second coverage rate that the second coverage rate is not lower than the first coverage rate (No in Step S203), the process proceeds to Step S208. If the comparing section 202 determines according to a result of comparison between the first coverage rate and the second coverage rate that the second coverage rate is lower than the first coverage rate (Yes in Step S203), the process proceeds to Step S204.

If Yes in Step S203, the determination section 204 determines a time period for executing the running-in operation based on a difference between the first coverage rate and the second coverage rate in Step S204. The process proceeds to Step S205.

In Step S205, the executing section 203 controls the replenishing sections 140 so that the replenishing sections 140 replenish the developing sections 110 with toner. The process proceeds to Step S206.

In Step S206, the executing section 203 controls the developing sections 110 so that the developing sections 110 supply toner to the respective photosensitive drums 101. The process proceeds to Step S207.

In Step S207, the executing section 203 drives the developing sections 110 so that the charge amount of toner in each developing section 110 comes to be equal to the charge amount of toner for image formation at the first coverage rate on a sheet P. The process returns.

If No in Step S203, the comparing section 202 determines whether or not the second coverage rate is higher than the first coverage rate in Step S208. If the second coverage rate compared with the first coverage rate is not higher than the first coverage rate (No in Step S208), the process returns. That is, if the comparing section 202 determines that the second coverage rate is not higher than the first coverage rate, the second coverage rate is equal to the first coverage rate. Therefore, the executing section 203 does not execute the running-in operation. When the comparing section 202 determines according to a result of comparison between the first coverage rate and the second coverage rate that the second coverage rate is higher than the first coverage rate (Yes in Step S208), the process proceeds to Step S209.

In Step S209, the determination section 204 determines a time period for executing the running-in operation based on a difference between the second coverage rate and the first coverage rate. The process proceeds to Step S210.

In Step S210, the executing section 203 drives the developing sections 110 so that the charge amount of toner in the developing sections 110 comes to be equal to the charge amount of toner for image formation at the first coverage rate on a sheet P. The process returns.

The embodiment of the present disclosure is described above with reference to the accompanying drawings. However, the present disclosure is not limited to the above embodiment and may be implemented in various manners within a scope not departing from the gist thereof. The elements of configuration disclosed in the above embodiment examples may be appropriately combined to form variations of the disclosure. For example, some elements of configuration may be deleted from all the elements described in the embodiment. Furthermore, elements of configuration of different embodiment examples may be appropriately combined. Aspects of the elements of configuration illustrated in the drawings, such as thickness, length, and number may differ in practice for the sake of convenience for drawing preparation. Aspects of the elements of configuration described in the above embodiment examples such as speed, material, shape, and dimension are merely examples and not particular limitations. The elements of configuration may be variously altered within a scope not substantially departing from the configuration of the present disclosure.

What is claimed is:

1. An image forming apparatus for forming an image on a sheet, the apparatus comprising:

a developing section containing toner and configured to develop an electrostatic latent image with the toner;

storage that stores therein respective coverage rates of a plurality of images individually formed on a plurality of sheets in past;

a first calculation section configured to calculate a first coverage rate and a second coverage rate;

a comparing section configured to compare the first coverage rate with the second coverage rate;

an executing section configured to execute a running-in operation based on a result of comparison by the comparing section, wherein the first coverage rate includes one or more coverage rates stored earlier in the storage than the second coverage rate among the coverage rates stored in the storage, the second coverage rate includes a coverage rate of each of a specified number of latest images individually formed on a specified number of sheets among the coverage rates stored in the storage, the running-in operation is driving the developing section so that a charge amount of the toner in the developing section comes to be equal to a charge amount of toner for image formation at the first coverage rate on a sheet, and when the result of comparison indicates that the second coverage rate is lower than the first coverage rate, the executing section executes the running-in operation.

2. The image forming apparatus according to claim 1, further comprising a replenishing section configured to replenish the developing section with toner, wherein when the result of comparison indicates that the second coverage rate is lower than the first coverage rate, the executing section controls the replenishing section so that the replenishing section replenishes the developing section with toner, controls the developing section so that the developing section expels the toner therein from the developing section, and executes the running-in operation.

3. The image forming apparatus according to claim 1, further comprising a determination section configured to determine a time period for executing the running-in operation based on a difference between the first coverage rate and the second coverage rate.

4. The image forming apparatus according to claim 1, wherein the first coverage rate includes an average value of one or more coverage rates stored earlier in the storage than the second coverage rate among the coverage rates stored in the storage, the second coverage rate includes an average value of the coverage rates of the specified number of latest images individually formed on the specified number of sheets among the coverage rates stored in the storage, and after the developing section forms an image on a sheet, the executing section executes the running-in operation.

5. The image forming apparatus according to claim 1, wherein the executing section executes the running-in operation at a specified time.

6. The image forming apparatus according to claim 1, wherein the executing section executes the running-in operation when the developing section returns from a first power state to a second power state, and the first power state is a state in which power consumption is lower than in the second power state.

7. The image forming apparatus according to claim 1, further comprising:

a photosensitive drum on which a toner image is formed with use of the toner supplied from the developing section;

an intermediate transfer belt to which the toner image is transferred from the photosensitive drum;

a density detector configured to detect a density of the toner image transferred to the intermediate transfer belt;

an electric current detector configured to detect an electric current flowing between the photosensitive drum and the developing section;

a second calculation section configured to calculate the charge amount of the toner in the developing section based on the density of the toner image detected by the density detector and a value of the electric current detected by the electric current detector; and an adjustment section configured to adjust a condition for forming an image on a sheet based on the charge amount of the toner in the developing section.

8. The image forming apparatus according to claim 7, wherein the adjustment section adjusts based on the charge amount of the toner in the developing section at least one of an amount of toner supplied from the developing section to the photosensitive drum, a rotational speed of a development roller of the developing section, a development bias applied to the development roller, a surface potential of the photosensitive drum, and an output of a suction fan.

* * * * *